United States Patent [19]

Tamaoki et al.

[11] Patent Number: 4,757,347

[45] Date of Patent: Jul. 12, 1988

[54] OIL APPLYING ROLLER FOR USE IN AN ELECTROPHOTOGRAPHIC COPYING APPARATUS

[75] Inventors: Junichi Tamaoki, Toyokawa; Tetsuya Yamada, Aichi; Sanji Inagaki, Toyokawa; Kesaaki Kitazawa, Mishima; Naotaka Nishikawa, Shizuoka; Youichi Ishikawa, Numazu; Kenji Takahashi, Mishima, all of Japan

[73] Assignees: Minolta Camera Kabushiki Kaisha, Osaka; Nitto Kogyo Co., Ltd., Tokyo; Hodaka Kogyo Co., Ltd., Shizuoka, all of Japan

[21] Appl. No.: 78,816

[22] Filed: Jul. 28, 1987

[30] Foreign Application Priority Data

Aug. 1, 1986 [JP] Japan ..... 61-182523

[51] Int. Cl.[4] ..... G03G 15/00; G03G 15/20

[52] U.S. Cl. ..... 355/3 FU; 355/3 R; 219/216; 29/110

[58] Field of Search ..... 355/3 R, 3 FU, 14 FU; 29/125, 129.5, 132, 110; 219/216

[56] References Cited

U.S. PATENT DOCUMENTS

| | | | |
|---|---|---|---|
| 4,324,482 | 4/1982 | Szlucha | 355/3 FU |
| 4,530,140 | 7/1985 | Okamura et al. | 29/110 |
| 4,533,231 | 8/1985 | Shigenobu | 355/3 FU |
| 4,536,076 | 8/1985 | Bickerstaff et al. | 355/3 FU |
| 4,571,056 | 2/1986 | Tani et al. | 355/3 FU |
| 4,593,992 | 6/1986 | Yoshinaga et al. | 355/3 FU |

FOREIGN PATENT DOCUMENTS

| | | |
|---|---|---|
| 50-13645 | 6/1975 | Japan . |
| 55-7725 | 1/1980 | Japan . |
| 60-172172 | 11/1985 | Japan . |
| 61-23184 | 1/1986 | Japan . |

*Primary Examiner*—A. C. Prescott

*Attorney, Agent, or Firm*—Burns, Doane, Swecker & Mathis

[57] ABSTRACT

Disclosed is an oil applying roller provided in contact with the surface of a fixing roller of an electrophotographic copying apparatus. The oil applying roller comprises a core member, an oil retaining layer and a surface layer. The surface layer has less oil retaining ability than that of the oil retaining layer. Thus the oil applying roller can supply a small amount of oil to the fixing roller stably.

4 Claims, 2 Drawing Sheets

OIL APPLYING ROLLER FOR USE IN AN ELECTROPHOTOGRAPHIC COPYING APPARATUS

BACKGROUND OF THE INVENTION

1. Field of the Invention

The present invention relates to an oil applying roller working as an oil applicator. The oil applying roller according to the present invention may be used in contact with the surface of a fixing roller of an electrophotographic copying apparatus. The fixing roller means a heat roller or a pressure roller of an electrophotographic copying apparatus.

2. Description of the Prior Art

The Japanese Laid-Open Utility Model No. 73762/1984 discloses a tank type oil applying roller of a conventional type. As shown in FIG. 1, the tank type oil applying roller 200 comprises an aluminum pipe 201 provided in the middle of the tank type oil applying roller and having through holes 202 on its periphery surface, an integrated fibrous material 203 provided on the surface of the aluminum pipe 201, and a heat resistance integrated fibrous material 204 provided on the surface of the integrated fibrous material 203.

The tank type oil applying roller 200 has an applying oil 205 filled in the hollow of the aluminum pipe 201. The oil 205 impregnates through the through holes 202 formed on the aluminum pipe 201 to the outer integrated fibrous materials 203 and 204 by the capillarity. The tank type oil applying roller 200 is provided in contact with the surface of a fixing roller. The tank type oil applying roller 200 applies the oil 205 to the surface of the fixing roller by rotating, and thus prevents offset of the toner particles from the copy sheet to the fixing roll. Further, the tank type oil applying roller 200 removes and cleans stains adhered on the surface of the fixing roller.

When an electrophotographic copying apparatus has been left unused for a long period of time, the conventional tank type oil applying roller applies a large amount of oil to the surface of the fixing roller especially in the initial stage of reusing. Accordingly, there has occurred a problem on the deterioration of the oil preservation and a problem on the largely varying oil applying amount depending on the size of paper or copying modes such as single-copying mode and multi-copying mode. Further, the copying paper has been stained with the oil when the oil applying amount is too much, and furthermore the non-paper delivered portions of the fixing roller have caused the worsened oil stain.

More specifically, the oil is equally applied to the fixing roller in spite of the size of copying papers. When the copying papers of small size, i.e., B5 size are successively fed to execute multi-copying, the oil is gradually accumulated at the portion on the fixing roller not contacting with the B5 papers (This portion is referred to as non-paper delivered portion hereinafter). If the copying papers of large size, i.e., A4 size are fed for copying operation after the multi-copying of B5 size papers, the portion of the A4 size paper contacting with the non-paper delivered portion may be stained with the accumulated oil.

SUMMARY OF THE INVENTION

Objects of the Invention

The present invention has been achieved in order to solve the above mentioned problems.

It is a major object of the present invention to provide an oil applying roller which can stably apply a small amount of oil to the fixing roller.

It is another object of the present invention to provide an oil applying roller free from oil leakage and having an improved oil preservation property.

It is a further object of the present invention to provide an oil applying roller which can apply the oil stably after a long lapse of time.

These and other objects of the invention can be accomplished by providing an oil applying roller which comprises a core member, an oil retaining layer formed on said core member, and a surface layer formed on said oil retaining layer, wherein the surface layer has less oil retaining ability than that of the oil retaining layers.

In other words, the oil applying roller according to the present invention is characterized by that it has layers differing in the oil retaining ability; i.e. the surface layer is formed outside the oil retaining layer, and the surface layer has less oil retaining ability than that of the oil retaining layer formed inside thereof.

DETAILED DESCRIPTION OF THE PREFERRED EMBODIMENT

An oil applying roller embodying the present invention will be hereinafter explained with reference to the accompanying drawings.

Figure 1:
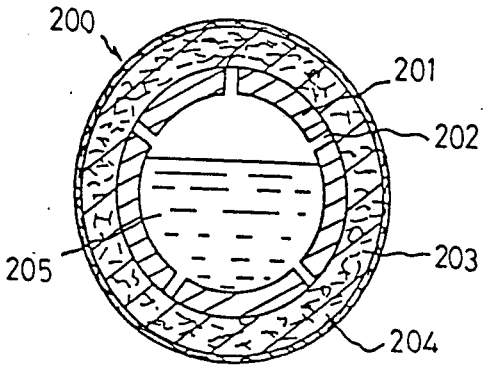
FIG. 1 (PRIOR ART)
FIG. 1 is a sectional view of a conventional oil applying roller.
Figure 2:
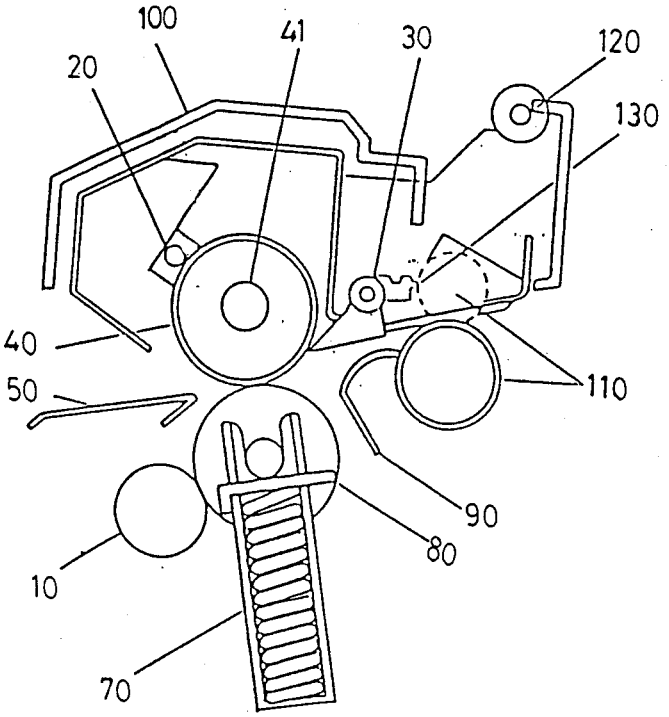
FIG. 2 is a sectional view of a fixing unit in which the oil applying roller embodying the present invention is provided.

FIG. 2 illustrates the sectional view of a fixing unit provided with an oil applying roller 10 according to the present invention. The fixing unit is enclosed with a cover 100. 40 designates a heat roller in which a heater 41 is fixedly provided, and 80 designates a pressure roller. The oil applying roller 10 is provided in contact with the surface of the pressure roller 80. A temperature detector 20 with a built-in thermistor and a thermal fuse is provided in contact with the surface of the heat roller 40.

The oil applying roller 10 provided in contact with the pressure roller 80 applies a small amount of oil stably to the pressure roller 80 as hereinafter explained. 70 designates springs for urging the pressure roller 80 upward when the upper portion of the copying apparatus is locked into position. 120 designates fixing unit pressure rollers for applying pressure to the fixing unit when the upper portion of the copying apparatus is locked into position.

A copying paper carrying a toner image thereon is brought into between the heat roller 40 and the pressure roller 80 by a guide plate 50, and the toner image is heat-fixed on the paper between the heat roller 40 and the pressure roller 80. Then the copying paper carrying thus fixed image thereon is separated from the heat roller 40 by separators 30, and is guided to a paper discharge rollers 110 by a paper guide plate 90. 130 designates a unit for detecting if there occurs paper jamming during the copying paper discharge.

Figure 3:
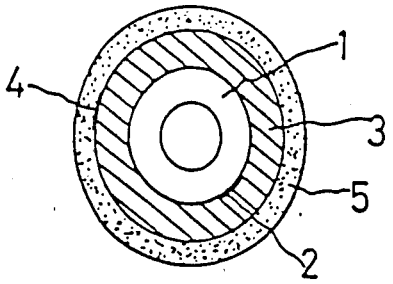
FIG. 3 is a sectional view of an oil applying roller embodying the present invention.
Figure 4:
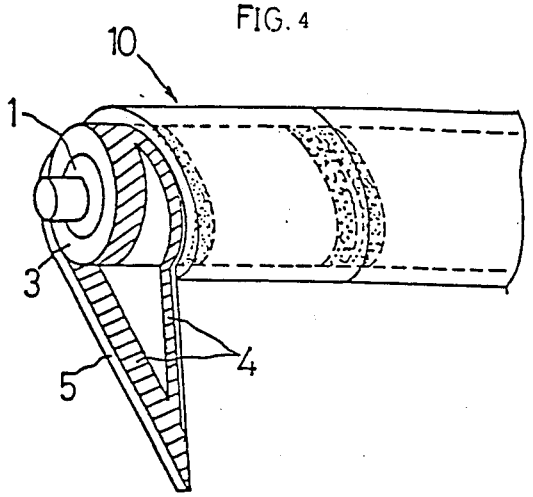
FIG. 4 is a perspective view, partially in section, of the oil applying roller embodying the present invention during manufacturing.

The oil applying roller 10 of the preferred embodiment comprises a core member 1, an oil retaining layer 3 and a surface layer 5 as shown in FIGS. 3 and 4.

The core member 1 is formed in the roll shape with 10 mm outer diameter and 240 mm effective length and is made of aluminum.

The oil retaining layer 3 is formed on the surface of the core member 1.

The oil retaining layer is for retaining the applying oil and supplying the applying oil to the surface layer. The oil retaining layer may be formed of a material having greater density than that of the surface layer provided outside thereof; i.e. the material exhibiting greater capillarity than that of the material for the surface layer. It is preferred to form the oil retaining layer out of a cellulose integrated fibrous material such as Ron Z produced by Molza Co., LTD. and the like with oil retaining density from 0.35 to 0.60 g/cm$^3$, because the oil should be supplied to the surface layer as well as retained in the oil retaining layer. The thickness of the oil retaining layer should not be specified. It may be determined depending on materials to be used, oils to be used and life span (or longevity).

In this embodiment, the oil retaining layer 3 is formed on the surface of the core member 1 by winding the Ron Z produced by Molza Co., LTD. with 0.17 mm thickness and then the total thickness of the oil retaining layer should be 3 mm. The used Ron Z has the oil retaining ability of 0.5 g/cm$^3$ for an oil with viscosity of 10000 CS.

The surface layer 5 is formed on the surface of the oil retaining layer 3.

The surface layer is provided in contact with the surface of the roller to which the oil is applied, and is for applying the oil to the roller and regulating the impregnation of the oil from the oil retaining layer. The surface layer is formed of a material having less density than that of the oil retaining layer; i.e. the material exhibiting less capillarity than that of the material for the oil retaining layer. It is preferred to form the surface layer out of Nomex Felt produced by E. I. du Pont Nemours and Co. and the like with oil retaining density from 0.05 to 0.30 g/cm$^3$. Considering the case that a heat roller is used in a fixing unit, it is preferred to use a heat resistant felt and the like for the surface layer.

In this embodiment, the surface layer 5 is formed on the surface of the oil retaining layer 3 by spirally winding the strip shape Nomex felt produced by E. I. du Pont de Nemours and Co. with 2 mm thickness. The used strip shape Nomex felt has the oil retaining ability of 0.3 g/cm$^3$ for an oil with viscosity of 10000 CS.

Figure 5:
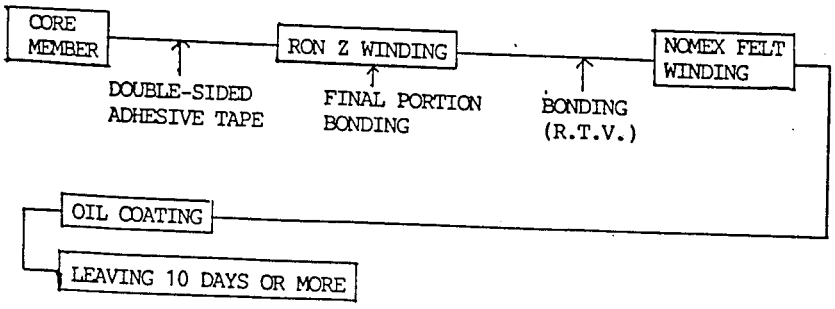
FIG. 5 is a block diagram illustrating manufacturing processes of the oil applying roller embodying the present invention.

Referring now to FIG. 5, the oil applying roller of the preferred embodiment is manufactured as follows:

The Ron Z is wound on the surface of the core member 1, and the both side-ends of the Ron Z are bonded by a double-sided adhesive tape 2. The both ends of the Nomex felt are coated with an R.T.V. (Room Temperature Vulcanization) adhesive 4 in advance. Then the Nomex felt is wound on the surface of the Ron Z spirally.

After coating an applying oil to the Nomex felt layer of the oil applying roller, the oil applying roller is left as it is for 5 to 10 days. The applying oil coated to the Nomex felt layer, i.e., the surface layer impregnates to the Ron Z layer i.e., the oil retaining layer as time passes, and the equilibrium of the oil retaining state is attained.

Unless an amount of oil exceeding the oil retaining ability has been coated to thus manufactured oil applying roller of the preferred embodiment, the oil applying roller is free from the oil leakage and has improved oil preservation property. As a result, after a lapse of long time, the oil applying amount will not increase and the oil applying roller can apply a stable amount of oil. Accordingly, the copying paper can be prevented from being stained with oil in the initial stage of copying apparatus reusing after the copying apparatus has not been used for a long period of time.

Since the oil applying amount depends on the wettability of the surface layer of the oil applying roller and that of the fixing roller provided in contact with the oil applying roller, the stain on the copying paper due to the non-paper delivered portions of the fixing roller can be decreased by using the oil applying roller wherein the equilibrium of the oil retaining state is maintained; i.e. wherein no oil movement occurs.

The operations of the oil retaining roller according to the present invention will be hereinafter explained with reference to FIGS. 2 to 4.

The oil applying roller according to the present invention is provided in contact with the surface of the fixing roller. The fixing roller means a heat roller or a pressure roller of an electrophotographic copying apparatus. In FIG. 2, the oil applying roller 10 is provided in contact with the pressure roller 80. Since the oil retaining layer 3 of the oil applying roller 10 according to the present invention has greater oil retaining ability than that of the surface layer 5, the applying oil contained in the oil applying roller 10 is retained in higher density in the oil retaining layer 3 than it is retained in the surface layer 5, and the equilibrium of the oil retaining state is maintained.

Consequently, when the oil applying roller 10 is rotated, a small amount of oil is applied gradually from the surface layer 5 to the fixing roller, i.e., the pressure roller 80. The oil moves from the oil retaining layer 3 to the surface layer 5 to maintain the equilibrium of the oil retaining state in accordance with the oil application. Thus the applying oil is supplied. And when the oil applying roller 10 is rotated, the toner and the like adhering to the surface of the fixing roller adheres to the oil applying roller 10 because of the wettability. Thus the cleaning of the fixing roller surface is performed.

Experiment

An experiment has been conducted to compare the performance of the oil applying roller of the preferred embodiment (hereinafter designated as (A)) with those of conventional rollers. The tank type oil applying roller (hereiafter designated as (B)) described in the description of the prior art section, an oilless (non-oil applying type) cleaning roller (hereiafter designated as (C)) are used as conventional rollers. The experiment has also been conducted on a case without an oil applying roller (hereinafter designated as (D)). A copying apparatus, EP360Z, manufactured by Minolta Camera K.K. is used in the experiment. The rollers are provided in contact with the surface of the pressure roller. The experiment has been conducted under the following conditions:

Heat roller: 30 mm diameter and teflon coated

Pressure roller: 30 mm diameter and L.T.V. (Low Temperature Vulcanization) silicon rubber coated Pressing force of the pressure roller against the heat roller: 40 kg Fixing temperature: 185° C.

Used oil: for (A): 20 g of dimethyl silicon oil with viscosity of 10000 CS. for (B): 40 g of dimethyl silicon oil with viscosity of 60000 CS.

Test mode: 250 copying papers for each of four sizes, A5, B5, A4 and B4 (paper sizes of Japanese Industrial Standard), are successively copied in this order, and the successive copying is repeated twice; i.e. 2000 pcs. of copying papers are copied a day. This mode of test is repeated in the following cycle: 5 days-on in succession and 2 days-off.

Chart: 6% of English characters

Result (1) Stain due to the adhering toner on the pressure roller (A): Almost no stain on the pressure roller after copying 60000 pcs. of copying papers.

(B): Almost no stain on the pressure roller after copying 60000 pcs. of copying papers.

(C): Paper jamming due to the stain on the pressure roller has occured after copying 30000 pcs. of copying papers.

(D): Paper jamming due to the stain on the pressure roller has occured after copying 20000 pcs. of copying papers.

Result (2) Stain due to the non-paper delivered portions (A): The stain has occured slightly during the initial stage; i.e. copying from 0 to 4000 pcs. of copying papers. No stain has occured later on.

(B): The stain has occurred always. The degree or level of stain has been worse.

Result (3) Oil applying amount per A4 size copying paper (A): 0.2 mg of the initial setting of the roller (A) to the copying apparatus, and 0.05 mg (The value has decreased gradually even after the initial setting of the roller (A) to the copying apparatus.)

(B): 0.6 mg after being left for 2 days, and 0.3 mg in average.

Evaluation

It is apparent from the results mentioned above that the oil applying roller of preferred embodiment, designated as (A), is extremely superior to the conventional oil applying rollers, because almost no stain has occured on the pressure roller and on the copying paper contacting with the non-paper delivered portions of the pressure roller.

A smaller oil applying amount is preferred if no stain is occurred on the pressure roller. Therefore it is also confirmed that the oil applying roller of preferred embodiment, designated as (A), is good in this respect.

The oil applying roller according to the present invention has the oil retaining layer with greater oil retaining ability than that of the surface layer. The oil retaining layer is provided inside of the surface layer. Accordingly, the oil applying roller can apply the oil to a fixing roller in a small amount from the surface layer.

When a copying apparatus is reused after having been left unused for a long period of time, no large amount of oil is applied even in the initial stage of reusing. Thus the oil applying roller according to the present invention can make the deviation of oil applying amount less and can apply the oil stably.

What is claimed is:

1. An oil applying roller provided in contact with the surface of a fixing roller for use in an electrophotographic copying apparatus comprising:

a core member;

an oil retaining layer formed on said core member; and a surface layer, formed on said oil retaining layer and having less oil retaining ability than that of said oil retaining layer, for regulating the amount of oil to be applied to said fixing roller.

2. An oil applying roller according to claim 1, wherein said oil retaining layer comprises a cellulose integrated fibrous material.

3. An oil applying roller according to claim 2, wherein said surface layer comprises a material having smaller density than that of said oil retaining layer.

4. An oil applying roller according to claim 3, wherein said surface layer comprises heat resistant felt.

* * * * *